United States Patent [19]

Khokhulin et al.

[11] 4,136,487

[45] Jan. 30, 1979

[54] ARRANGEMENT FOR ABRASIVE MACHINING OF SHAPED SURFACES

[76] Inventors: Vladimir N. Khokhulin, Sredneokhtinsky prospekt, 26/17, kv. 75; Andrei N. Grachev, ulitsa Ryleeva, 39, kv. 1; Valery G. Shver, Bolshoi prospekt, 104, kv. 24; Valentin L. Kozlov, prospekt Energetikov, 28, korpus 7, kv. 27, all of Leningrad, U.S.S.R.

[21] Appl. No.: 853,268

[22] Filed: Nov. 21, 1977

[51] Int. Cl.[2] ..... B24B 17/00

[52] U.S. Cl. ..... 51/33 R

[58] Field of Search ..... 51/33 R, 33 W, 101 R, 51/168

[56] References Cited

U.S. PATENT DOCUMENTS

| | | | |
|---|---|---|---|
| 2,335,625 | 11/1943 | Wilson | 51/33 R |
| 3,286,407 | 11/1966 | Lockwood | 51/33 R |
| 3,484,996 | 12/1969 | Gardner | 51/33 R |

*Primary Examiner*—Nicholas P. Godici

*Attorney, Agent, or Firm*—Lackenbach, Lilling & Siegel

[57] ABSTRACT

The arrangement for abrasive machining comprises a base member, connected with the headstock of a copy milling machine, and a casing, made in the form of a hollow cylinder, connected with the base member by articulated suspensions. Mounted in the seat of the hollow cylinder, by means of an intermediate sleeve, is a tool spindle which carries the abrasive tool. The intermediate sleeve has a spherical bearing with a flat end. The tool spindle is coupled to the rotary drive means by a flexible shaft and an intermediate shaft joined together by a splined joint. The arrangement also comprises a device for urging the abrasive tool against the surface to be machined, which includes an urging force adjustment means formed by a socket disposed in the hollow cylinder, spring-biased towards the flat end of the spherical bearing by its end and provided with a central hole for receiving the flexible shaft. The reciprocating drive means for the hollow cylinder is formed by an end-face cam rigidly secured to the intermediate shaft and engaging a plunger connected with the hollow cylinder.

8 Claims, 2 Drawing Figures

ARRANGEMENT FOR ABRASIVE MACHINING OF SHAPED SURFACES

FIELD OF THE INVENTION

The present invention relates to machine tools and, more particularly, to arrangements for abrasive machining of shaped surfaces.

The present invention can be used for abrasive machining of curved surfaces of an intricate shape, such as shaped surfaces of rotor blades for steam and gas turbines and axial compressors used in power plant and vehicle applications.

The present invention can be most advantageously utilized for coarse and fine (dimensionless) honing of shaped surfaces of large-sized rotor blades, using copying devices.

DESCRIPTION OF THE PRIOR CUT

Known in the art is an arrangement for abrasive machining of shaped surfaces, comprising a fixed base and a casing secured thereto and connected with a drive means providing a straight-line reciprocating motion of the casing with respect to the fixed base. The casing is provided with a seat for supporting, on a spherical bearing, a tool spindle which carries an abrasive tool, the tool spindle being connected with the rotary drive means for cyclic rotation of the abrasive tool about the axis of the spindle. The tool spindle has a device for urging the abrasive tool against the surface to be machined, thereby resulting in permanent contact of the two surfaces.

The most serious disadvantage of the known arrangement is its low efficiency, particularly when machining a large continuous surface, caused by a comparatively low resultant speed of rotation of the abrasive tool relative to the work surface due to the intermittent nature of the rotary motion of the abrasive tool. Further, the known arrangement can only be used for finishing operations, since the layer of metal removed within one cycle of operation of the abrasive tool is not thick enough as a result of an insufficient force urging the tool against the work surface.

SUMMARY OF THE INVENTION

It is an object of the present invention to provide a highly efficient arrangement for abrasive machining of shaped surfaces with an intricate profile.

Another object of the present invention is to provide an arrangement for abrasive machining of shaped surfaces, equally suitable both for coarse and fine honing operations.

Still another object of the present invention is to provide an arrangement for abrasive machining of shaped surfaces to ensure a uniform depth of cutting, due to a constant force urging the abrasive tool in a plane extending normal at any point of the work surface.

A further object of the present invention is to provide an arrangement for abrasive machining of shaped surfaces, enabling the force urging the abrasive tool against the work surface to be readily adjusted.

With these and other objects in view, there is proposed an arrangement for abrasive machining of shaped surfaces comprising a base member and a casing connected therewith and coupled to a drive means for reciprocating motion relative to the base member. The casing has arranged within a seat, supported by a spherical bearing, a tool spindle rotatably mounted and carrying the abrasive tool urged against the surface to be machined. According to the invention, the casing is made in the form of a hollow cylinder connected with the base by articulated suspensions and accommodating an intermediate sleeve. The spherical surface of the spherical bearing is formed coaxially with the opening of the sleeve and its flat end lies in a plane extending normal to the axis of the sleeve. The tool spindle is mounted within the sleeve and is coupled to the rotary drive means by a flexible shaft and an intermediate shaft joined to each other by a splined joint. The sleeve is moved by an urging device provided with an urging force adjustment means and formed by a socket mounted in the hollow cylinder and spring-biased against the flat end of the spherical bearing by its end. The socket has an axial hole for receiving the flexible shaft. An end-face cam is rigidly secured to the intermediate shaft and is in engagement with a plunger connected to the hollow cylinder.

The advantage of the proposed arrangement for abrasive machining is that the abrasive tool executes a composite controlled working movement, including a rotary motion and a reciprocating motion along the arc with respect to the base, following the geometry of the curved surface portion being machined, which is made possible by virtue of the hollow cylinder being coupled to the base member by means of the articulated suspensions.

The splined joint of the flexible shaft with the intermediate shaft may be in the form of a coupling comprising one semi-coupling mounted on the end of the intermediate shaft and embracing the other semi-coupling mounted on the end of the flexible shaft, the contacting surfaces of both coupling halves being provided with longitudinal grooves forming, when aligned, holes to receive the balls.

Such a construction of the splined joint permits an improved transmission of rotary movement from the intermediate shaft to the flexible shaft due to reduced friction as a result of the balls being used as the hollow cylinder is simultaneously reciprocated.

The plunger of the reciprocating drive means may be formed by a rocking lever mounted on a support attached to the base and connected with the hollow cylinder by a damping rod.

This construction of the plunger combined with the end-face cam provides an easy adjustment of the arrangement to the optimum cutting performance, i.e., the proper choice of the rate, speed, and amplitude of the reciprocating motion of the tool.

The urging force adjustment means adjusting the force urging the abrasive tool against the surface to be machined may be formed by a screw positioned in a threaded bore provided in the hollow cylinder, the end of the screw engaging a spring and having an axial hole to receive the flexible shaft.

Such a construction of the urging force adjustment means provides for simple and easy control the force of urging the abrasive tool against the work surface.

According to one embodiment, the urging force adjustment means is a reduction valve connected with a hollow cylinder via a pipe connection to move the socket within said cylinder.

This embodiment of the arrangement allows the range of adjusting the force urging the abrasive tool against the work surface to be extended in an upward direction.

BRIEF DESCRIPTION OF THE DRAWINGS

These and other objects as well as the advantages of the present invention will become apparent from the following detailed description of specific embodiments taken in connection with the accompanying drawings in which.

DETAILED DESCRIPTION OF THE INVENTION

Figure 1:
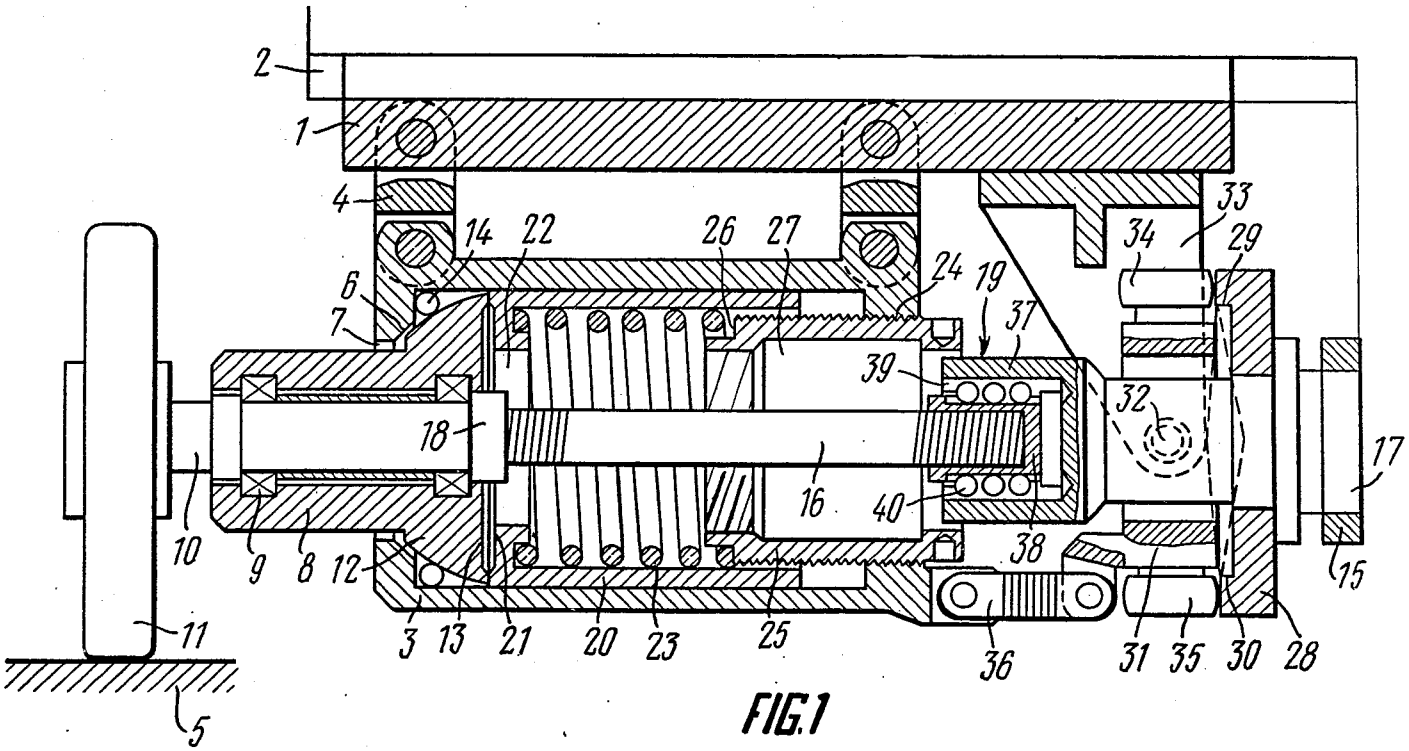
FIG. 1 is a longitudinal, cross sectional view of an arrangement for abrasive machining of shaped surfaces, according to the invention.

The arrangement for abrasive machining of curved surfaces of an intricate profile using the honing operation comprises a base member (FIG. 1) in a fixed relationship with a headstock 2 of a machine such as the circular copy milling machine, and a casing. The casing is made in the form of a hollow cylinder 3 connected with the base 1 by articulated suspensions 4 and adapted to be reciprocated through an arc relative to the base 1 along the surface of a workpiece 5 to be machined, e.g. the rotor blade of a steam or gas turbine. In a seat 6 of the hollow cylinder 3, with an opening 7, there is a tool spindle 10 rotatably mounted by means of an intermediate sleeve 8 on ball bearings 9 disposed in the central bore of the sleeve. The spindle 10 carries an abrasive tool 11, e.g. an abrasive wheel rigidly secured to its projecting end. Formed in the intermediate sleeve 8 is a spherical surface coaxial with the hole of this sleeve and constituting a spherical bearing 12 of the intermediate sleeve 8 with a flat end 13 formed in a plane extending normal to the axis of the intermediate sleeve 8. Also disposed in the seat 6 is a ball cage 14 for reducing friction between the surface of the seat 6 and the surface of the spherical bearing 12. The total spindle 10 is connected with a spindle 15 of the machine mentioned hereinabove, serving as a drive means for its rotation, by a flexible shaft 16 and an intermediate shaft 17, the tool spindle 10 being coupled to the flexible shaft 16 by a union nut 18 and the flexible shaft 16 being joined by a splined joint 19 to one end of the intermediate shaft 17, the other end of the shaft 17 being clamped to the spindle 15. The device for urging the abrasive tool 11 against the surface of the workpiece 5 comprises a socket 20 located in the hollow cylinder 3, its flat end 21 being in permanent engagement with the flat end 13 of the spherical bearing 12, and having an axial hole 22 for receiving the flexible shaft 16. The socket 20 is held against the flat end 13 of the spherical bearing 12 by a coiled spring 23 disposed within this socket. A threaded bore 24 is provided in the hollow cylinder 3 for reception of a screw 25 with its end 26 contacting the spring 23 to adjust the urging force exerted by the abrasive tool 11. Formed in the shank of the screw 25 is an axial hole 27 to receive the flexible shaft 16. The reciprocating drive of the hollow cylinder 3 comprises an end-face cam 28 with three lobes, of which a pair of lobes is shown in the drawing at 29 and 30. The end-face cam 28 is rigidly secured to the intermediate shaft 17 and engages a plunger formed by a rocking lever 31 supported by journals 32 mounted on brackets 33 attached to the base 1. Fitted on the ends of the rocking lever 31 are rotating rollers 34 and 35 directly engaging the contact surface of the end-face cam 28 to provide for reduced friction between this surface and the rocking lever 31. The rocking lever 31 is hinged to the hollow cylinder 3 via a sandwich type damping rod 36 comprising a plurality of steel plates and rubber plates arranged laterally to the rod and bolted together, the bolts also acting as members for fastening the rod 36 to the hollow cylinder 3 and the rocking lever 31.

The splined joint comprises a coupling consisting of a semi-coupling 37 disposed on the end of the intermediate shaft 17 and embracing a semi-coupling 38 disposed on that end of the flexible shaft 16 adjacent the intermediate shaft 17. On the internal surface of the semi-coupling 37 and the external surface of the semi-coupling 38, which are in contact with each other, there are provided equidistant semicircular longitudinal grooves, each of the grooves of the semi-coupling 37 being aligned with a respective one of the grooves of the semi-coupling 38 to form holes 39 for receiving balls 40.

Figure 2:
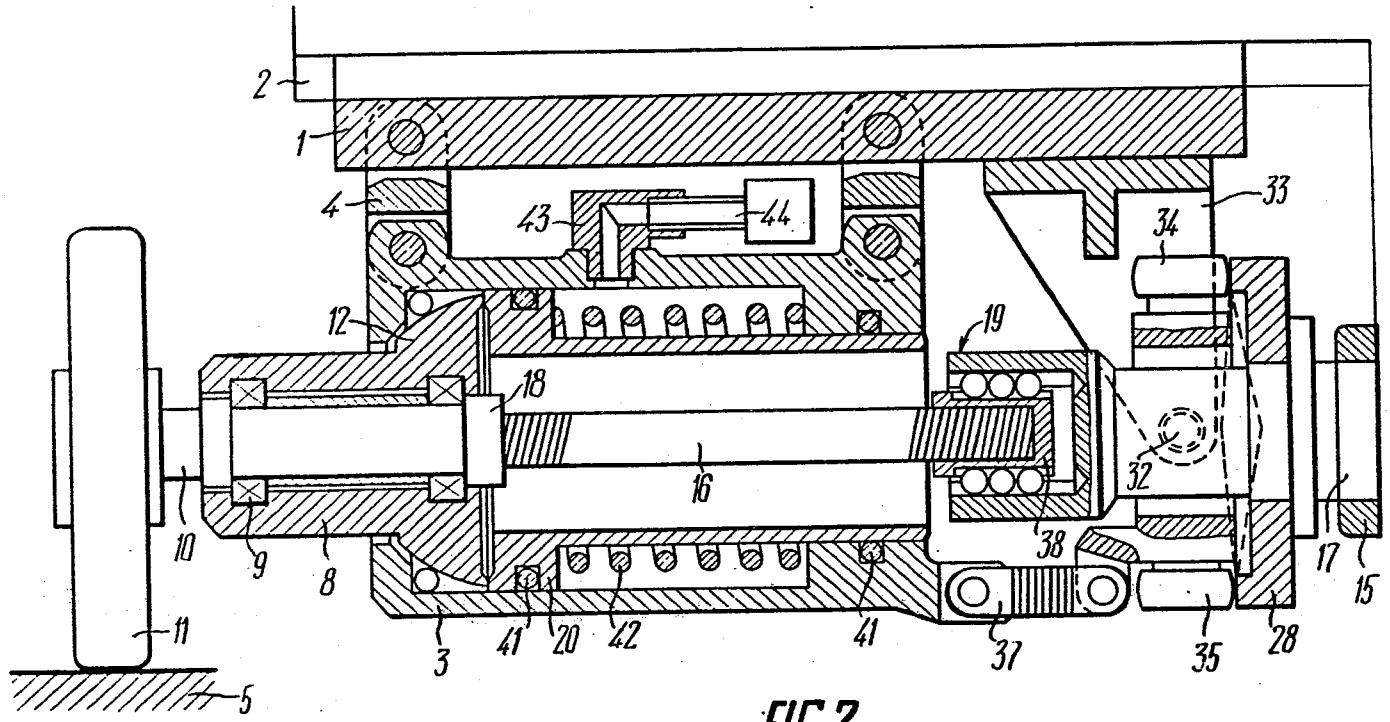
FIG. 2 is a longitudinal, cross sectional view of another embodiment of an arrangement for abrasive machining of shaped surfaces, according to the invention.

FIG. 2 shows an embodiment of the proposed arrangement for abrasive machining wherein the hollow cylinder 3 is formed of an air-operated power cylinder, the socket 20 mounted in the hollow cylinder on sealing members 41 being the piston of this power cylinder. In this case, the socket 20 is held against the spherical bearing 12 of the intermediate sleeve 8 by the bias of a coiled spring 42 and by the force exerted by the socket 20 acting as the piston of the power cylinder connected to an aerial system (not shown) by means of a pipe connection 43 via a reduction valve 44 which serves to pneumatically control the force involved in urging the abrasive tool 11 against the surface of the workpiece 5 to be machined. Such reduction valves are widely known and a detailed description of them is given in literature, known by those skilled in the art; therefore, the reduction valve 44 is only shown in a diagrammatic form.

The proposed means for abrasive machining operates in the following way.

Prior to operation, the device for urging the abrasive tool 11 against the workpiece 5 is adjusted to a predetermined urging force. To this end, the abrasive tool 11 is moved towards, and resiliently urged against, the surface of the workpiece 5 to be machined, using appropriate mechanisms of the aforementioned machine. The force urging the abrasive tool 11, in the embodiment of FIG. 1, is governed by the machining conditions and by the material to be machined and is adjusted by compressing of the coiled spring 23 by turning the screw 25.

The rotation of the spindle 15 of the machine is transmitted through the intermediate shaft 17, the splined joint 19, and the flexible shaft 16 directly to the tool spindle 10 which carries the abrasive tool 11. As the intermediate shaft 17 is rotated, the lobes 29, 30 of the end-face cam 28 mounted on the shaft alternately depress the upper and lower end of the rocking lever 31. Now by virtue of the connection of the lever 31 through the damping rod 36 with the hollow cylinder 3, the cylinder 3 is reciprocated relative to the base member 1 and, owing to the hollow cylinder 3 being connected with the base 1 by articulated suspensions 4, this movement follows the arc of a radius determined by the space between the axes of the articulated suspensions 4. Abrupt shocks imparted to the hollow cylinder 3 by the plunger of the reciprocating drive means are absorbed by the damping rod 36 as a result of the suppression of inertial forces developed in the process. Thus the abrasive tool 11 travels in a composite movement relative to the surface of the workpiece 5, including a rotary motion and a reciprocating motion along an arc, which follows the geometry of the portion of the curved surface being machined, thereby applying a constant urging to the abrasive tool 11, which force is directed in a plane extending normal at any point of the surface to be machined due to the spherical bearing 12 in the construction. If required, the urging force may be adjusted by turning the adjustment screw 25 in the threaded bore 24.

The operation of the embodiment of FIG. 2 is essentially similar to the operation of the preferred embodiment of the arrangement shown in FIG. 1, except that the initial force of urging the abrasive tool 11 against the surface of the workpiece 5 to be machined is provided by the spring 42, and the amount of the working force is adjusted by the reduction valve 44. In this case, a greater urging force can be used for the abrasive tool, since the reduction valve 44 enables any desired pressure to be applied to the socket 20 and adjusted within specified limits.

Thus optimum performance in the process of honing shaped surfaces by the abrasive tool 11 is provided, with the proposed arrangement, by control of the following factors:

peripheral speed of rotation of the abrasive tool 11 being controlled by proper selection of the revolutions of the spindle 15 of the machine;

characteristics of the reciprocating motion of the tool 11, i.e. the amplitude and the rate of oscillations being governed by the selected profile of the endface cam 28 and the number of reciprocating strokes of the tool being dependent on the number of cam lobes, which should be odd;

the contact between the abrasive tool 11 and the surface of the workpiece 5 to be machined being controlled by the movement of the copying mechanism of the machine; and the stable cutting force of the abrasive tool 11 being set by the constant force urging the tool against the surface to be machined, at any point of contact, exerted by the urging device.

The resultant speed of working movement of the abrasive tool 11 relative to the surface of the workpiece 5 to be machined is about 1 m/s. The thickness of the layer of metal removed on one pass of the abrasive tool 11 may vary according to the material machined, the type of abrasive, the cutting speed, and the urging force applied, and may range from 0.01 to 0.05 mm during a fine honing operation, or up to 0.4 mm during a coarse honing operation.

The arrangement in accordance with the present invention provides:

a considerable saving of manual labor when machining curved surfaces of large-sized rotor blades for turbines and axial-flow compressors, as well as mechanization and automation of the machining process, which gives a time-saving and labor-saving effect;

machining shaped surfaces both in the coarse honing mode and in the fine honing mode being made feasible by adjustment of the force urging the abrasive tool against the surface to be machined;

machining shaped surfaces in the two aforementioned honing modes at low temperatures, which is extremely favorable, particularly in making articles of titanium alloys, which are liable to form burned areas when machined at high contact temperatures inherent in the grinding process;

minimizing the warping effect, i.e. the effect of occasional distortions of geometry of the turbine blade surface being machined on the surface roughness of the machined blades, due to a slight variation in the total urging force within the warping value on the order of 2 to 3 mm; and crossing tracks left by the abrasive tool on the surface being machined, which results from the composite movement of the tool and permits a uniform distribution of residual stresses on the machines surface of the workpiece as well as a substantial reduction of greasing the abrasive wheel.

It will be understood that the present invention is not restricted to the specific embodiments herein described and illustrated and that various modifications and other embodiments of the proposed means for abrasive machining of shaped surfaces may be made without departing from the scope and spirit of the present invention.

What is claimed is:

1. An arrangement for abrasive machining of shaped surfaces of an intricate profile, comprising:

a base member;

articulated suspensions attached to said base member;

a casing made in the form of a hollow cylinder connected with said base member by said articulated suspensions and having a seat with an opening;

an intermediate sleeve mounted in said seat of said hollow cylinder and having formed thereon a spherical surface coaxial with said intermediate sleeve to serve as a spherical bearing of this sleeve, said spherical bearing having a flat end in a plane extending perpendicular to the axis of said intermediate sleeve;

a tool spindle disposed in said intermediate sleeve; an abrasive tool secured to one end of said tool spindle; a flexible shaft coupled to the other end of said tool spindle;

a rotary drive means for said tool spindle;

an intermediate shaft coupled to said rotary drive means;

a splined joint for joining said flexible shaft to said intermediate shaft;

a device for urging said abrasive tool against the surface to be machined including:

a socket positioned in said hollow cylinder and having an end-face engaging said flat end of said spherical bearing, said end-face of said socket being provided with an opening to receive said flexible shaft, a spring for urging said socket against said flat end of said spherical bearing of said intermediate sleeve, and an urging force adjustment means for adjusting the force urging said socket against said flat end of said spherical bearing; and a reciprocating drive means for said hollow cylinder including an end-face cam rigidly mounted on said intermediate shaft and a plunger connected with said hollow cylinder and engaged by said end-face cam;

whereby said abrasive tool performs simultaneously a rotary motion and a reciprocating motion along an arc relative to said base member, a constant controlled urging force being directed in a plane extending normal at any point of the surface to be machined.

2. An arrangement according to claim 1, wherein said splined joint comprises a coupling including a first semi-coupling, with a plurality of longitudinal grooves formed on its outside surface, mounted on that end of said flexible shaft adjacent said intermediate shaft, and a second semi-coupling, with a plurality of longitudinal grooves on its inside surface, disposed on the end of said intermediate shaft and embracing said first semi-coupling, each of said grooves of said first semi-coupling being aligned with a respective one of said grooves of the second semi-coupling to form holes; and balls positioned in said holes.

3. An arrangement for abrasive machining according to claim 1, wherein said plunger includes a support attached to said base member, a rocking lever mounted on said support, and a damping rod coupling said rocking lever to said hollow cylinder.

4. An arrangement for abrasive machining according to claim 1, wherein said hollow cylinder is provided with a threaded bore, and said urging force adjustment means for said abrasive tool comprises a screw positioned in said threaded bore, said screw having an end in contact with said spring and an axial hole for receiving said flexible shaft.

5. An arrangement for abrasive machining according to claim 1, further comprising a pipe connection attached to said hollow cylinder; and wherein said hollow cylinder is a power cylinder, said socket of said urging device for said abrasive tool being the piston of said power cylinder, and said urging force adjustment means being a reduction valve connected with said hollow cylinder via said pipe connection.

6. An arrangement for abrasive machining in accordance with claim 2, wherein said plunger includes a support attached to said base member, a rocking lever mounted on said support, and a damping rod coupling said rocking lever to said hollow cylinder.

7. An arrangement for abrasive machining according to claim 6, wherein said hollow cylinder is provided with a threaded bore, and said urging force adjustment means for said abrasive tool comprises a screw positioned in said threaded bore, said screw having an end engaging said spring and an axial hole for receiving said flexible shaft.

8. An arrangement in accordance with claim 6, further comprising a pipe connection attached to said hollow cylinder; and wherein said hollow cylinder is a power cylinder, said socket of said urging device for said abrasive tool being the piston of said power cylinder, and said urging force adjustment means being a reduction valve connected with said hollow cylinder via said pipe connection.

* * * * *